US010807743B2

(12) United States Patent
Sisken et al.

(10) Patent No.: US 10,807,743 B2
(45) Date of Patent: Oct. 20, 2020

(54) SYSTEMS AND METHODS FOR FILLING AND SEALING VIALS

(71) Applicant: Muffin Incorporated, West Lafayette, IN (US)

(72) Inventors: Richard B. Sisken, West Lafayette, IN (US); James Thomas Jones, Brookston, IN (US); Charles Leland Baxter, West Lafayette, IN (US); Marc C. Buhrmester, Dayton, IN (US); William J. Havel, West Lafayette, IN (US); James D. Purdy, Lafayette, IN (US); Neal E. Fearnot, West Lafayette, IN (US); Kyle D. Amick, West Lafayette, IN (US)

(73) Assignee: Muffin Incorporated, West Lafayette, IN (US)

( * ) Notice: Subject to any disclaimer, the term of this patent is extended or adjusted under 35 U.S.C. 154(b) by 712 days.

(21) Appl. No.: 15/282,001

(22) Filed: Sep. 30, 2016

(65) Prior Publication Data

US 2017/0144782 A1 May 25, 2017

Related U.S. Application Data

(60) Provisional application No. 62/234,943, filed on Sep. 30, 2015.

(51) Int. Cl.
*B65B 3/04* (2006.01)
*B65B 3/00* (2006.01)
(Continued)

(52) U.S. Cl.
CPC ..... *B65B 3/003* (2013.01); *A61J 1/067* (2013.01); *B65B 3/04* (2013.01); *B65B 7/02* (2013.01);
(Continued)

(58) Field of Classification Search
CPC .. A61J 1/065; A61J 1/067; B65B 1/04; B65B 3/003; B65B 3/00; B65B 3/04;
(Continued)

(56) References Cited

U.S. PATENT DOCUMENTS 2,449,478 A 9/1948 Herzog
2,639,554 A * 5/1953 Zons ..... B65B 7/161 65/60.51
(Continued)

FOREIGN PATENT DOCUMENTS

DE 199 16 662 A1 10/2000
WO WO 2016/004594 A1 1/2015

OTHER PUBLICATIONS

International Application No. PCT/US2016/054851 International Search Report and Written Opinion, dated Feb. 1, 2017.

*Primary Examiner* — Andrew M Tecco
*Assistant Examiner* — Eyamindae C Jallow
(74) *Attorney, Agent, or Firm* — Woodard, Emhardt, Henry, Reeves & Wagner LLP

(57) ABSTRACT

A filling and sealing system is provided for efficiently filling a series of individual vials with therapeutic liquids. In particular embodiments, the system includes a filling zone or station, a sealing zone or station, an unloading zone or station, and electronic controls.

24 Claims, 6 Drawing Sheets

(51) Int. Cl.

| | |
|---|---|
| ***B65B 51/14*** | (2006.01) |
| ***B65B 7/16*** | (2006.01) |
| ***A61J 1/06*** | (2006.01) |
| ***B65B 7/02*** | (2006.01) |
| ***B65B 39/04*** | (2006.01) |
| ***B65B 39/12*** | (2006.01) |
| ***B65B 51/10*** | (2006.01) |

(52) U.S. Cl.
CPC ..... *B65B 7/161* (2013.01); *B65B 39/04* (2013.01); *B65B 39/12* (2013.01); *B65B 51/10* (2013.01); *B65B 51/142* (2013.01)

(58) Field of Classification Search
CPC .... B65B 3/14; B65B 3/18; B65B 3/26; B65B 7/00; B65B 31/00; B65B 57/00
USPC ..... 53/266.1, 284.5, 284.6, 432, 510; 422/558
See application file for complete search history.

(56) References Cited

U.S. PATENT DOCUMENTS 3,012,386 A * 12/1961 Pechmann ..... B41F 17/18 53/411
3,496,695 A * 2/1970 Helmut ..... B65B 3/003 53/432
3,730,235 A * 5/1973 Lewis ..... B65B 3/003 141/172
3,734,147 A * 5/1973 Borutta ..... A61M 5/1782 141/27
4,266,681 A * 5/1981 Fredericks ..... A61J 1/065 215/47
4,465,501 A * 8/1984 Lemonnier ..... A61L 2/28 65/105
5,394,979 A * 3/1995 Hall ..... B65H 1/30 198/836.3
5,617,705 A * 4/1997 Sanfilippo ..... B65B 31/00 53/281
5,641,004 A * 6/1997 Py ..... B65B 3/003 141/10
6,301,859 B1 * 10/2001 Nakamura ..... B29C 65/18 53/373.7
6,336,489 B1 * 1/2002 McGahhey ..... B29C 66/849 156/368
6,418,982 B1 * 7/2002 Zhang ..... B65B 3/003 141/18
2004/0065048 A1 * 4/2004 Kondo ..... B65B 3/34 53/75
2006/0136095 A1 * 6/2006 Rob ..... A61J 1/20 700/245
2006/0259195 A1 * 11/2006 Eliuk ..... A61J 1/20 700/245
2007/0125442 A1 * 6/2007 Tribble ..... B65B 3/003 141/27
2008/0105581 A1 * 5/2008 Kondo ..... B65B 3/003 206/438
2009/0013646 A1 * 1/2009 Mastio ..... A61L 2/082 53/425
2009/0038273 A1 * 2/2009 Thurgood ..... B29C 65/18 53/477
2009/0223592 A1 * 9/2009 Procyshyn ..... B25J 21/00 141/2
2010/0243103 A1 * 9/2010 Ono ..... B65B 3/003 141/129
2016/0152359 A1 * 6/2016 Fontana ..... B65B 51/142 206/459.5
2016/0368629 A1 * 12/2016 Storey ..... B65B 3/003

* cited by examiner

SYSTEMS AND METHODS FOR FILLING AND SEALING VIALS

This application claims the benefit of U.S. Provisional Application Ser. No. 62/234,943, filed Sep. 20, 2015, which is incorporated by reference in its entirety.

The present disclosure concerns filling systems for vials used for therapeutic substances. In particular embodiments, the disclosure concerns systems for making vials of biological therapeutic substances quickly and with security.

BACKGROUND

It has long been known to package therapeutic substances in small or individual packages so that waste is reduced, e.g. a significant amount remains that is unusable or may be tainted. Methods and systems for efficient and rapid production of such vials or packages are important and need improvement.

In the field of biological therapeutical substances, not only must appropriate doses of such treatments be efficiently prepared, but they must be stored and transported so as to maintain their effectiveness. Biological therapeutic agents, such as solutions of cells, can be denatured with time and heat, and such denatured agents can not only be ineffective but may present some hazard in some cases. Accordingly, once packaged such agents may be stored under cool conditions, or frozen to a temperature up to hundreds of degrees below zero Celsius.

Vials suitable for such packaging and storage have recently been developed. For example, U.S. Pat. No. 8,709,797 discloses such devices, and is incorporated herein by reference in its entirety. What is needed is a system for efficiently filling and sealing such devices.

SUMMARY

Among other things, there are disclosed embodiments of structure and methods for filling individual vials with therapeutic liquids, and in particular biological solutions including for example, cells for therapeutic use. Such systems may include one or more of a loading or filling zone, a sealing zone and an unloading zone, as well as electronic controls and data collection and storage devices for operation and monitoring of the system's performance. A carriage moves one or more vials through the zones, and in particular embodiments the carriage includes a slotted platform and/or guide for holding parts of the vials, for example an inlet tube and/or sealing cap of each vial. A slotted locking bar pivots with respect to the vials and the platform and/or guide, and maintains the vials in place.

In the loading zone, the vials are filled via a filling fixture with a liquid (e.g. biological solution) nozzle and an air nozzle. The liquid nozzle is connected to a liquid dispenser that draws from a liquid reservoir, and the air nozzle is connected to an air dispenser. The liquid nozzle is lowered into the inlet tube of a vial, and an amount of the liquid is dispensed so that liquid is in a main chamber and an aliquot of the liquid remains in the inlet tube of the vial. The liquid nozzle is withdrawn, and the air nozzle is inserted. In some or all vials, air is delivered into the inlet tube to create an air pocket above the aliquot, and then a portion of the air in the pocket is removed to move the aliquot up in the inlet tube and create a second air pocket in the inlet tube below the aliquot. Alternatively, in some or all vials air is delivered into the inlet tube to force all liquid from the inlet tube into the chamber.

Once all vials are filled in the loading zone, they are moved to the sealing zone. In particular embodiments, multiple sealing bars are provided that have heated sealing elements outside of pinching elements. For those vials having air pockets bounding an aliquot in their inlet tubes, the pinching elements meet the inlet tubes of the respective vials at the location of the air pockets, to maintain the aliquot away from the heated sealing elements. All vials are sealed at the same time and in the same relative location in particular embodiments.

After sealing, the vials are moved to an unloading zone for removal and storage. The carriage is returned to the loading zone, and a new set of one or more vials (e.g in a tray) are loaded for another loading and sealing cycle.

Controls and methods for governing and performing filling and sealing are also disclosed. As one example, embodiments of a two-touch activation and operation of a filling system is described.

DESCRIPTION OF THE ILLUSTRATED EMBODIMENTS

Figure 1:
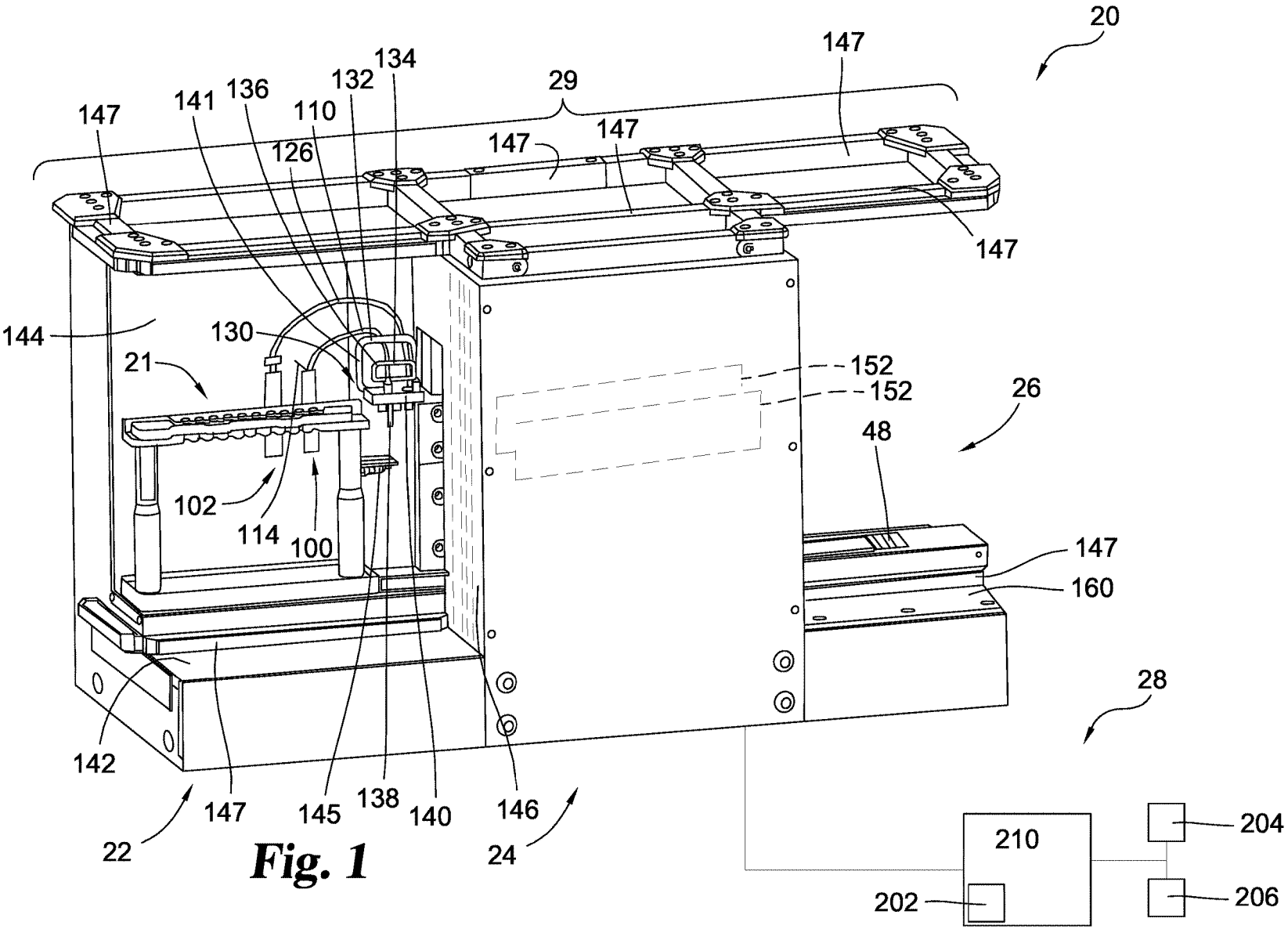
FIG. 1 is a perspective and part-schematic view of an embodiment of a system for filling vials.
Figure 2:
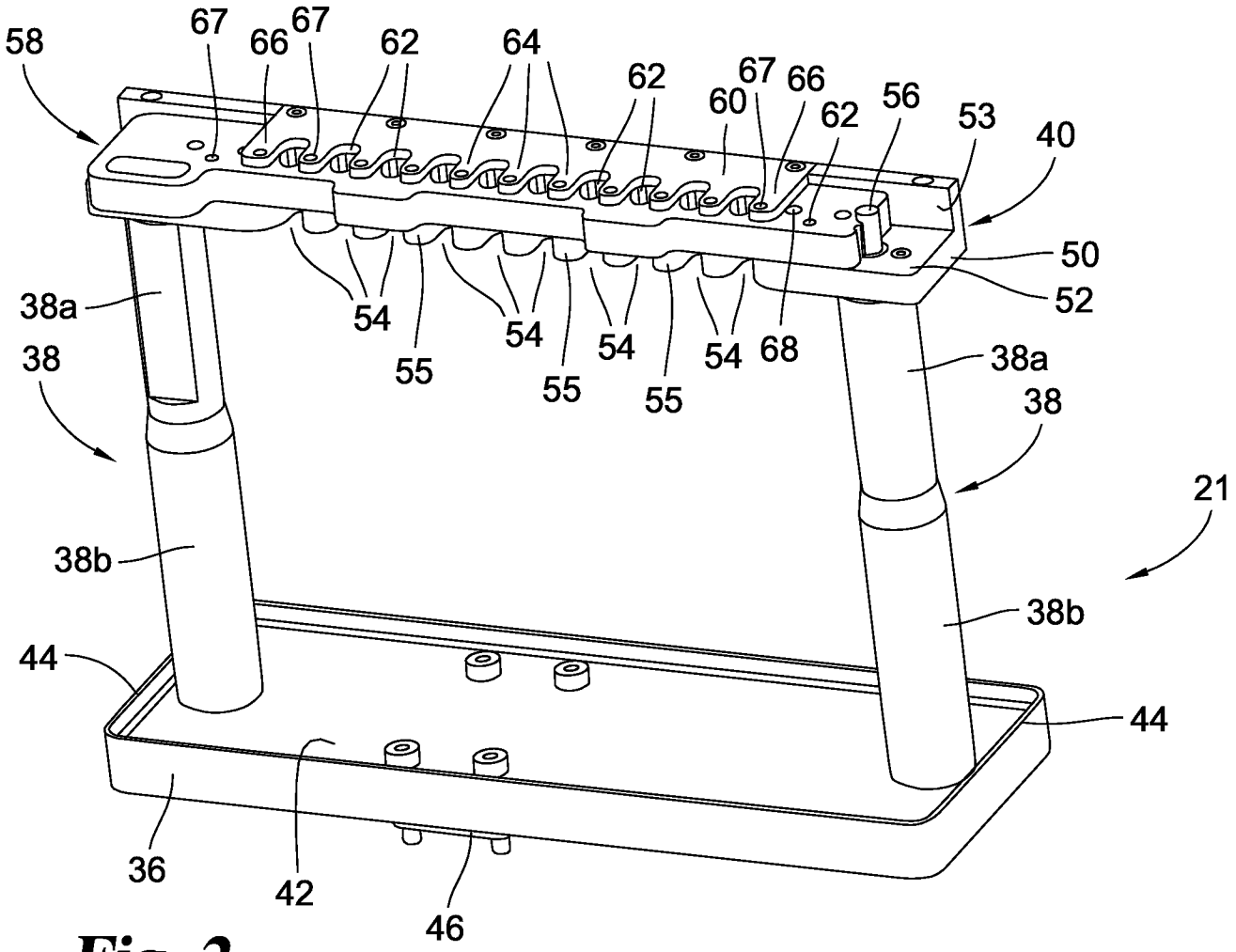
FIG. 2 is a perspective view of an embodiment of a portion of the system of FIG. 1.
Figure 3:
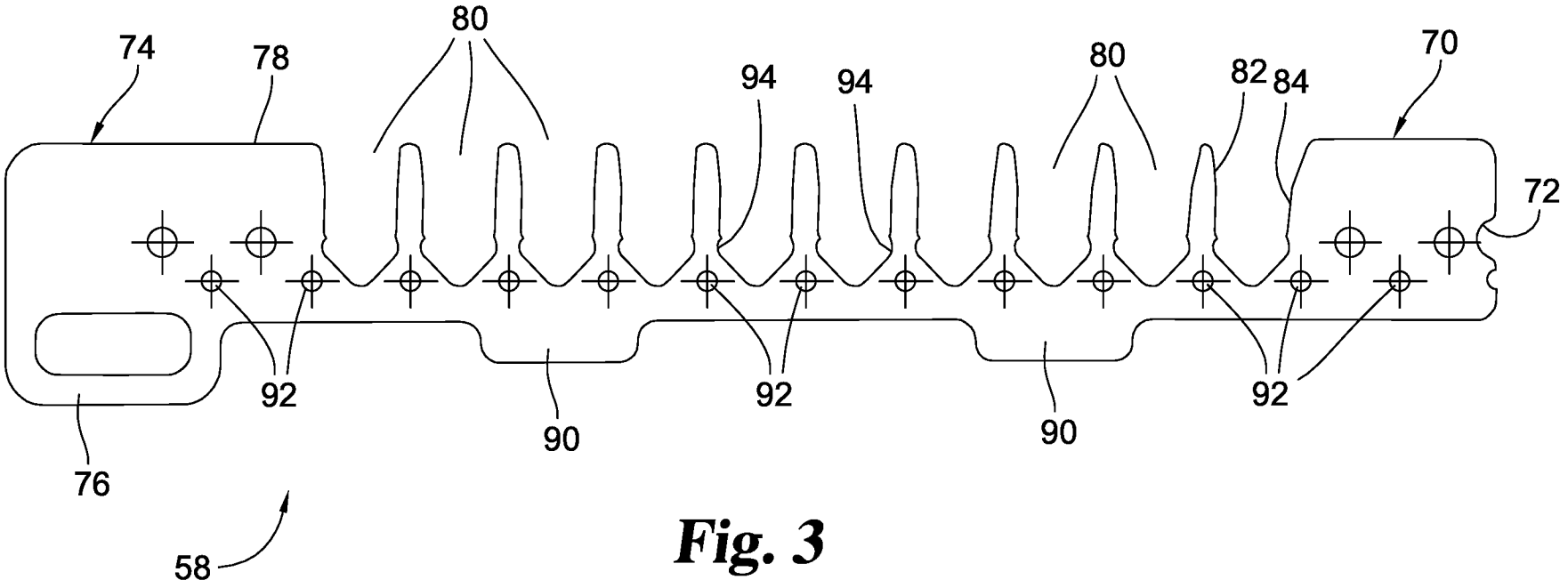
FIG. 3 is a top view of an embodiment of a locking bar used in the embodiments of FIGS. 1 and 2.

To promote an understanding of the principles of the disclosure, reference will now be made to certain embodiments and specific language will be used to describe the same. It will nevertheless be understood that no limitation of the scope of the claims is thereby intended, such alterations and further modifications of the disclosed methods and/or devices, and such further applications of the principles of the disclosure as described herein, being contemplated as would normally occur to one skilled in the art to which the disclosure relates.

Referring now generally to the drawings, there is shown an embodiment of a system 20 for filling vials, e.g. with therapeutic substances that may include biological components such as cells. System 20 includes a vial carriage 21 that travels between an input, loading or filling zone 22, a sealing zone 24 and an output or unloading zone 26. In this particular embodiment, zones 22, 24 and 26 form a unit or device 29 that can be used under a biological hood or in another small sterile environment. Control hardware and software 28 is indicated schematically in the drawings, and may be at least partially remote from a sterile environment in which unit 29 is used. In this embodiment, carriage 21 progresses from left to right travelling from loading zone 22 through sealing zone 24 to unloading zone 26. It will be understood that a right-to-left, part-circular, or other progression could be used if desirable.

Carriage 21 is designed to carry a number of vials 32 through a filling and sealing process in the illustrated embodiment, and includes a tray 36 acting as a base, with a pair of upright supports 38 holding an upper mount 40. Tray 36 is a flat horizontal plate 42 having side upwardly-extending (e.g. vertical) walls 44. Tray 36 is intended to contain any drips or spillage that may occur from the vials 32 during filling. Since system 20 may be used for cellular solutions or other biologically-based substances, it may be important to have containment pieces or features such as tray 36 that maintain accidental spills in an easily-disassembled and cleaned (e.g. autoclavable) part, and away from other less-accessible parts of system 20. On the underside of tray 36 is a drive linkage 46 for driving connection to a travel bar 48, which operates to move linkage 46 and carriage 21 between loading zone 22, sealing zone 24 and unloading zone 26. In the illustrated embodiment, linkage 46 is a block having an internally threaded hole (not shown) and travel bar 48 is a threaded rod extending through the three zones.

Supports 38 are anchored to and extend upward from an upper surface of tray 36. Supports 38, like tray 36, are of an autoclavable material such as stainless steel in a particular embodiment. A top half 38*a* of each support 38 is removably linked to a bottom half 38*b* that is secured to tray 36. In such an embodiment, the link between halves 38*a* and 38*b* is a quick-release or lift-off connection, e.g. via one or more pins in one of halves 38*a* and 38*b* fitting in an aperture in the other half. For cleaning or maintenance, for example, top halves 38*a* can be lifted off or otherwise disconnected from bottom halves 38*b*, so that the top halves 38*a* (and features fixed to it) can be cleaned or sterilized (e.g. autoclaved), and easily replaced.

Upper mount 40 includes an L-shaped platform 50 in this embodiment, having a horizontal arm 52 and a vertical arm 53. Horizontal arm 52 is fixed to supports 38, and includes a series of slots 54 perpendicular to vertical arm 53 for accommodating vials 32. Dividers 55 between adjacent pairs of slots 54 are elongated and have convexly rounded tips to assist in guiding a vial 32 into a slot 54. The illustrated embodiment includes ten slots 54, with nine dividers 55 and end portions of horizontal arm 52 to define them. A post 56 extends through or from arm 52 as a pivot point or axle for vial cap locking bar 58. Vertical arm 53 of platform 50 supports a guide 60 in this embodiment. Guide 60 includes a series of slots 62 between dividers 64 and ends 66. Slots 62 are generally the same size in length and narrower in with compared to slots 54 of platform 50, to permit a portion of vial 32 to snap into slot 62. In other embodiments slots 62 may be greater or smaller in sized based on the relative size of associated aspects of vials 32. Each of horizontal arm 52 and guide 60 includes registration holes 67, for use in ensuring accurate filling and air treatment of vials 32, as will be discussed further below.

Guide 60 is fixed to vertical arm 53 so as to extend over horizontal arm 52, with slots 54 and 62 aligned. A gap or channel 68 is defined by and between guide 60 and horizontal arm 52, in which bar 58 can pivotably lodge. Bar 58 has a first end 70 with a slot 72 for accommodating post 56, and a second end 74 with a grip or handle 76. Pulling on handle 76 pivots bar 58 away from vertical arm 53 of platform 50 through channel 68, while pushing handle 76 pivots bar 58 into channel 68. When bar 58 is fully within channel 68, it rests against vertical arm 53 of platform 50 in this embodiment.

Bar 58 has an inner surface 78 that faces vertical arm 53 of platform 50. A series of slots 80 open at surface 78, so that their open ends face vertical arm 53. Slots 80 generally align with slots 54 and 62 when bar 58 is in the closed position, i.e. when inner surface 78 is against or closest to vertical arm 53. With the pivoting motion of bar 58 and the intent to maintain portions of vials 32 within slots 54 and 62 as bar 58 is closed, slots 80 are non-uniform in this embodiment. The slot 80 nearest end 70 has a far edge 82 and a curved near edge 84 (i.e. nearer to post 56 than edge 82 is to post 56). Edge 84 has a convex curvature that is a portion of a circle in this embodiment centered on post 56. Each of the respective slots 80 has such a pair of edges, with the edge nearer post 56 having a convex curve. Given the differing distances from axle 56 of each slot 80, the curvature of each respective near edge 84 will be different, with the greatest curvature closest to post 56, and the least curvature furthest from post 56. If each slot edge 84 is considered to be along a respective concentric circle centered on post 56, it will be seen that the curvature of the most-distant concentric circle is substantially less in magnitude than that of the closest concentric circle to post 56. The curvature is provided so that each slot 80 can be moved around a part of a respective vial 32 as bar 58 pivots around post 56. It will be understood that in some embodiments curvature can be eliminated along one or more slots 80 that are furthest from post 56.

The outside edge of bar 58 (i.e. the side opposite surface 78 and vertical arm 53 of platform 50) includes two thumb-push tabs 90 in the illustrated embodiment. That example shows tabs 90 having a distance between them that is the same as the distance between handle 76 and the tab 90 nearer to it, and as the distance between the end 70 of bar 58 and the tab nearer to it. Tabs 90 provide an easy to see and find surface for the operator to press on if needed to close bar 58 with respect to platform 50. Bar 58 also includes a plurality of locating or registration holes 92. In the illustrated embodiment, there is a registration hole 92 adjacent pivot slot 72 (e.g. about equidistant from slot 72 and the closest slot 80), and another registration hole 92 even with handle 76. Additional registration holes 92 are positioned along bar 58 so that a pair of holes 92 brackets or straddles each slot 80. Each registration hole 92 is equidistant from its neighboring holes 92, i.e. the distance between adjacent holes 92 is constant. Holes 92 align with registration holes 67 in guide 60 and platform 50 when system 20 is in an operational mode. Notches 94 are provided in the edges of slots 84, to assist in holding vial 32.

Figure 4:
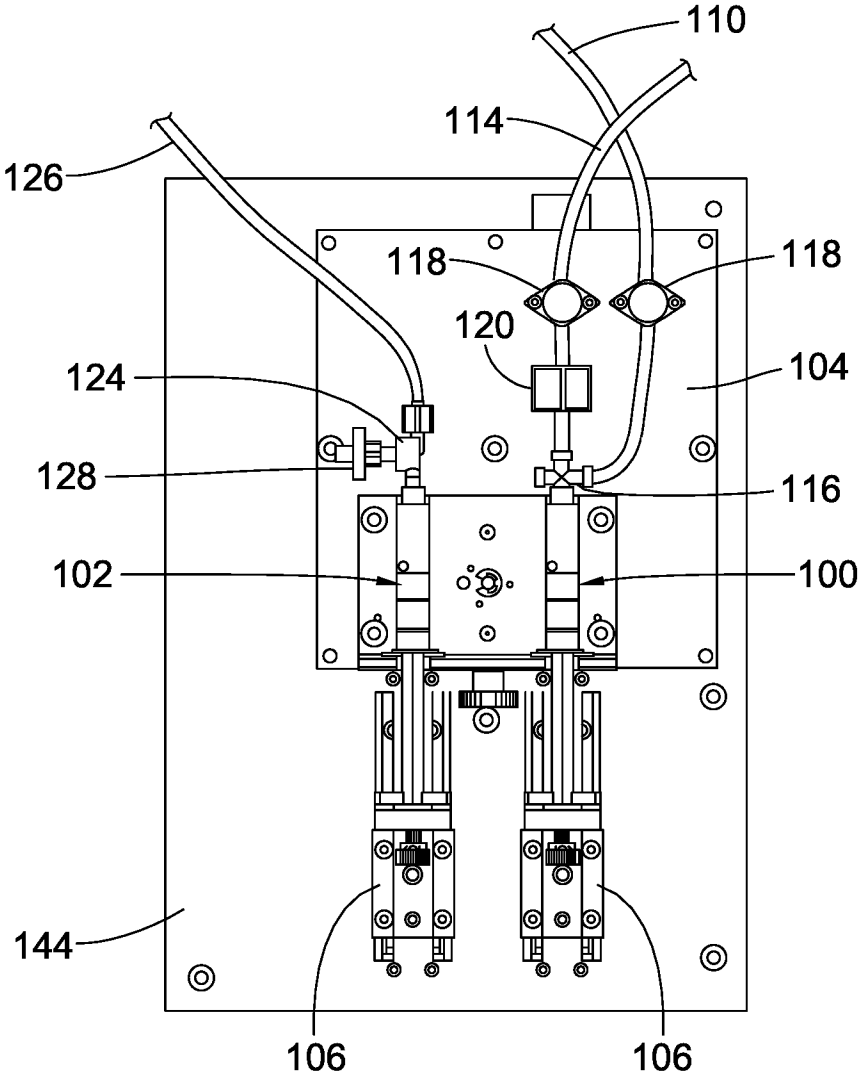
FIG. 4 is a front view of an embodiment of a portion of the system of FIG. 1.
Figure 5B:
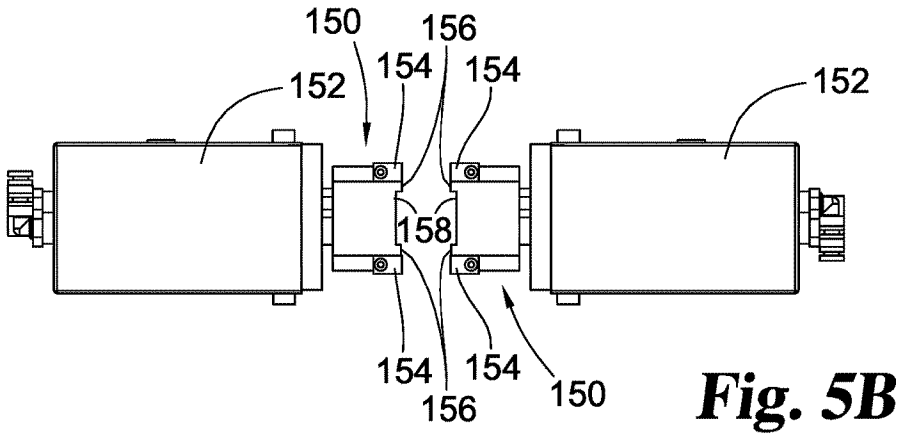
FIG. 5B is a side view of embodiments of a portion of the system of FIG. 1, unmounted from the structure shown in FIG. 1.
Figure 5A:
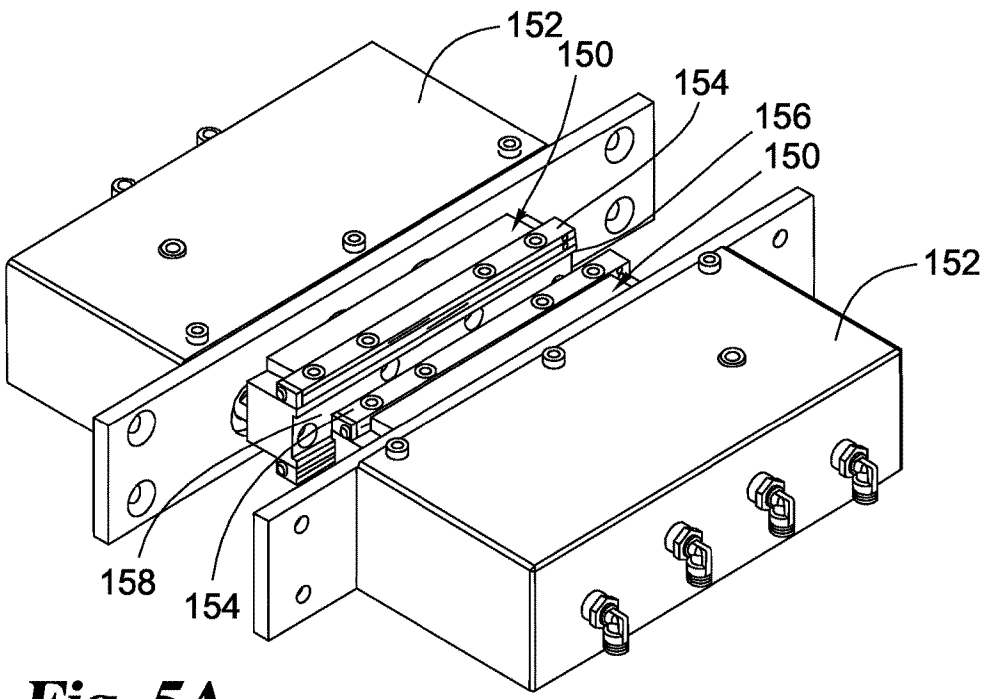
FIG. 5A is a perspective view of embodiments of a portion of the system of FIG. 1, unmounted from the structure shown in FIG. 1.

Loading zone or station 22 includes a liquid dispenser 100 and air dispenser 102, each of which are syringes in the illustrated embodiment having respective barrels, plungers, and nozzles or tips. FIG. 4 shows a particular embodiment, some features of which are indicated in FIG. 1 to preserve clarity. Each barrel is fixed to a frame 104, which in turn may be attached to a rear wall of loading zone 22. In the illustrated embodiment, each syringe is fixed to frame 104 with the nozzle up and the plunger down, for ease of maintenance and because in that configuration the liquid dispenser syringe is easier to purge of air bubbles when priming system 20. Respective actuators 106 (e.g. motors and/or pistons) are fixed with respect to the respective plungers in this embodiment, to draw and push them with respect to their respective barrels. In embodiments in which liquid dispenser 100 and air dispenser 102 are not syringes, appropriate actuators for drawing desired volumes of liquid and air and for dispensing them are provided.

Liquid dispenser 100 is connected to a liquid reservoir (not shown) which is outside of loading zone 22, sealing zone 24, and unloading zone 26 in the illustrated embodiment. The connection is via a fluid line 110. Dispenser 100 is also connected to a fill nozzle of a filling fixture via a fluid line 114. A connector 116 (e.g. a three- or four-way connector) is engaged to the nozzle or tip of dispenser 100, and lines 110 and 114 fit in connector 116 in such an embodiment. Lines 110 and 114 (and other fluid conduits herein) are flexible plastic tubing in one example. Feed line 110 passes through an electronically-controlled pinch valve 118 in a particular embodiment, for stopping flow through feed line 110 as may be desired and/or in a shut-down mode. Fill line 114 likewise passes through its own pinch valve 118. A bubble sensor 120 (e.g. an ultrasonic sensor) is placed between connection 116 and pinch valve 118 along fill line 114. Sensor 120 detects a condition in which air or other gas is present in fill line 114 rather than liquid, which may indicate that the reservoir supplying fluid is empty and needs replaced or replenished, or that a fault or error condition exists in system 20 (e.g. in its filling area). Sensor 120 is also used during initial priming of system 20, e.g. when connecting a new reservoir, to determine when sufficient liquid has been drawn from the reservoir and through to fully occupy fill line 114.

Air dispenser (e.g. syringe) 102 is fitted with a connector 124 (e.g. at the nozzle of its syringe), which connects to an air line 126 and an intake 128 with an internal air filter and valve. Air is drawn in during an intake process (e.g. actuator 106 draws out the plunger) through the filter and valve. The filter may be a biofilter, e.g. screening out not only particulates or other relatively large contaminants but also bacteria or other biological contaminants from air as it passes through. Air pushed out of air dispenser 102 travels along line 126.

Air line 126 and liquid fill line 114 each connect to a fill fixture 130. Fixture 130 in one form includes a liquid nozzle 132, and air nozzle 134, an actuator 136, and a registration pin 138. In the illustrated embodiment, nozzles 132 and 134, actuator 136, and pin 138 are fixed to a platform 140 that moves vertically between an upper position, in which carriage 21 loaded with vials 32 can pass under nozzles 132, 134 and pin 138, and a lower position in which at least one of nozzles 132 and 134 and pin 138 are respectively in a vial 32 and a set of aligned registration holes 67, 92. In a particular embodiment, fixture 130 is raised and lowered by a bar (not shown) extending through a rear wall 144 and connected to a motor. A silicone boot 141 covers the bar and the hole in rear wall 144 through which it extends in order to maintain the clean environment within zone 22. Liquid nozzle 132 is connected to fill line 114 extending from liquid dispenser 100, and air nozzle 134 is connected to air line 126 from air dispenser 102. Nozzles 132 and 134 and pin 136 are positioned with respect to each other in the same relationship as exists between a registration hole 92 and the two following slots 80 (i.e. the two vials 32 following the particular registration hole 92 of bar 58).

Loading zone 22 in this embodiment has an open front and left side with a ledge 142 in front of carriage 21, and closed in back by wall 144 to which frame 104 and liquid dispenser 100 and air dispenser 102 are fixed. In particular embodiments, a barrier or screen (preferably clear, e.g. plastic, not shown) may be placed between carriage 21 and wall 144, so that in the event of any malfunction or error that may occur in filling zone 22 liquid will remain in front of the screen, away from the operating parts of dispensers 100 and 102 and their associated components, and therefore easier to clean. A vial sensor 145 is placed on wall 144 so as to detect when there is no vial available for filling. A side wall 146 separates sealing zone 24 from loading zone 22. As a safety feature, sensors 147 (e.g. light curtains) are placed above and to the open side of loading zone 22, and on the ledge 142 adjacent carriage 21. Sensors 147 communicate with the software that controls system 20, so that if an operator's hand or other object trips a sensor 147 during operation, the system 20 will stop until the object is removed and system 20 is restarted.

Ledge 142 is provided for the operator to rest his or her hands and/or tools or other necessary pieces. Unit 29 may be used under a hood, e.g. a biologically-sterile or -controlled environment, and in such usages it is undesirable to move in or out of the hood space more than is strictly necessary.

Sealing zone 24 is between loading zone 22 and unloading zone 26, and in the illustrated embodiment has a closed front and partially-closed sides. Sensors 147 may be placed around an open top and on the sides of zone 24 where carriage 21 travels into and out of zone 24. Sealing zone 24 includes a set of sealing bars 150 mounted at a height suited to sealing vials 32 at a desired location, and movable toward each other to heat-seal vials 32. The general process of heat-sealing is well-known, involving pressing together heated elements on either side of a plastic piece to be sealed. A press-seal is formed in the substance of the piece. While such a process is known, bars 150 have been developed with particular features and uses.

Bars 150 are pneumatically movable toward and away from each other via pneumatic controllers 152. In particular embodiments, exhaust gas from the pneumatic cylinders within controllers 152 is vented externally. Each bar 150 includes upper and lower elongated heated elements 154 to apply heat and pressure and form separate upper and lower seals on inlet tubes I of vials 32. Between elements 154 are unheated pinching elements 156 and between the two pinching elements 156 is a gap or depression 158. In the illustrated embodiment, bar 150 has a U-shape forming the pinching elements 156 and depression 158. Heating elements 154 are fixed to bar 150 and outside of elements 156. The middle or body of bar 150 acts as a heat sink, so that heat from elements 154 is focused on the sealing function, and is not significantly transferred to or is quickly dissipated from pinching elements 156.

As described further herein, sealing bars 150 place two seals in tubes I of vials 32. One or more of tubes I has an aliquot of fluid trapped between air pockets. As bars 150 come together on either side of the tubes, pinching elements 156 contact the tubes at the air pockets, i.e. outside of the location of the aliquot of liquid in the tube. Pinching elements 156 press the tube without applying heat, to maintain the liquid away from the heat of sealing elements 154. Maintaining heat away from the liquid can be important in cases where the liquid includes cells for therapy or another heat-sensitive component. When sealing is complete and bars 150 retract, tube material contacted by pinching elements 156 is not sealed, but returns to its initial condition. Dual seals are present in each tube I, separated by the air pockets from any liquid aliquot inside.

Unloading zone 26 is an open area having a ledge 160 and sensors 147, substantially as described above with respect to loading zone 22. Ledge 160, like ledge 142, allows a space for tools, operator's hands or the like to minimize need to move in and out of a hood space.

Carriage 21 travels among zones 22, 24, 26 on threaded rod 48 in this embodiment. As rod 48 turns with respect to linkage 46, carriage 21 moves along rod 48. The filling process in loading zone 22 uses several short movements. Once vials 32 are filled, carriage 21 is moved to sealing zone 24 for sealing the vials 32. When sealing is complete, carriage 21 is moved to unloading zone 26. Vials 32 are removed from carriage 21 for storage or transport, and then carriage 21 moves back through sealing zone 24 directly to loading zone 22. In particular embodiments, a two-touch activation is programmed into system 20. A switch (e.g. a foot switch, not shown) is pressed when system 20 is loaded, and the filling and sealing steps occur automatically under control of software without further pressing of the switch, unless an error or fault is detected (e.g. an operator breaks the beam of a light curtain safety sensors). Once carriage 21 arrives at unloading zone 26, the carriage's travel stops. When removal of the vials from carriage 21 is complete, a second operation of the switch moves carriage 21 back to loading zone 22. If an error or fault causes carriage 21 to stop in mid-cycle, with concomitant stoppage of processes in system 20, once the error or fault is corrected, pressing the switch will cause system 20 to resume processing.

Vials 32 used with system 20 in particular embodiments are described in U.S. Pat. No. 8,709,797, incorporated herein by reference in its entirety. For example, a vial 32 is shown having a main holding chamber C, a vent tube V (with an internal filter element, not shown) and an inlet tube I. As will be discussed further, vials 32 are filled in a closed manner. At least some of the vials 32 are filled so that chamber C has a desired amount of fluid and so as to provide and maintain a sealed aliquot of the liquid within inlet tube I. Such a sealed aliquot allows testing of the liquid without spoiling liquid within chamber C.

Multiple vials 32 may be mounted in a tray 170. Tray 170 has individual concavities 172, into each of which a respective vial 32 (e.g. its chamber C) can be snapped. The tubes V, I of each vial 32 extend above the upper extent of tray 170. The number of vials per tray may vary, but preferably is the same as the number of slots 80, 54 and 62 in bar 58, platform 50 and guide 60. The illustrated embodiment includes ten spaces 172 for ten vials 32, and ten slots 54, 62, 80 are provided to accommodate the vials in the parts of carriage 21. In such an embodiment, thirteen registration holes 67, 92 are provided in bar 58, platform 50 and guide 60 for guiding fixture 130.

System 20 is first primed by drawing liquid from the reservoir into lines 110 and 114 through dispenser 100 to fill nozzle 132. As noted above, bubble sensor 120 notes when line 114 is full of air, and permits system 20 to operate as described below when line 114 is full of liquid. With system 20 prepared for loading, e.g. with carriage 21 stationary within loading zone 22 and locking bar 58 pivoted outward, a tray 170 with empty vials 32 is loaded by fitting inlet tubes I of vials 32 into slots 54 of platform 50 (and slots 62 of guide 60). In particular embodiments, a portion of inlet tubes I or sealed caps T of vials 32 snap into and are held within slots 54 and/or 62. Locking bar 58 is pivoted into channel 68 so that each of its slots 80 accommodate and enclose a respective tube I of a vial 32.

With vials 32 locked into carriage 21, the operator presses the operating switch (e.g. a foot switch, not shown) to begin operation. The operator may maintain his or her hands on ledge 142 so as to keep them within a hood in which unit 29 is placed, so long as they do not break the beams of light curtains 147, which will stop operation as discussed above.

Figure 6:
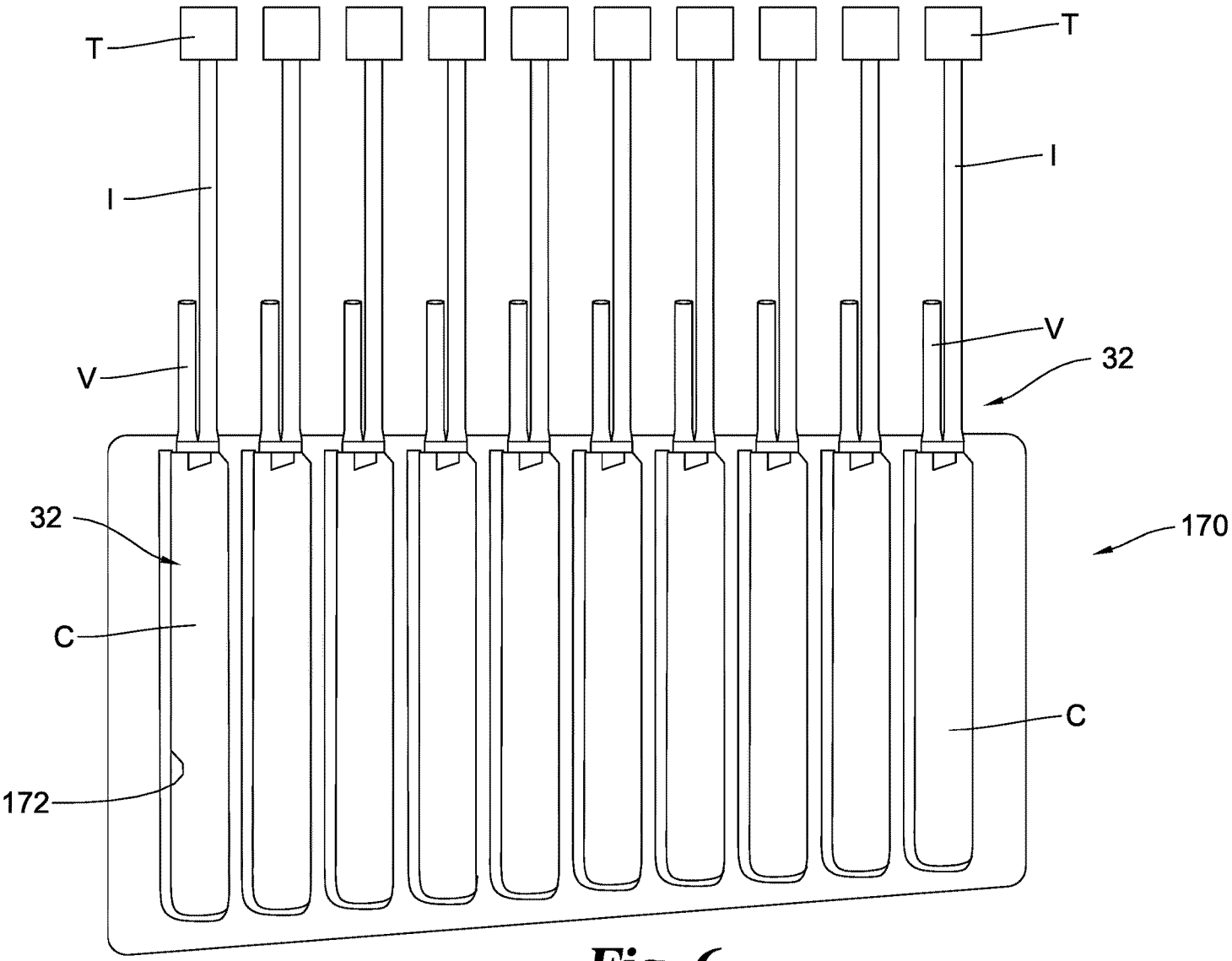
FIG. 6 is a perspective view of an embodiment of a tray of vials usable in the embodiment of the system shown in FIG. 1.

As the first vial 32 (e.g. the right-most in FIG. 6, in the right-most slot 54 of platform 50) reaches filling fixture 130, fixture 130 moves toward its downward position. Registration pin 138 enters registration holes 67, 92, and liquid fill nozzle 132 enters inlet tube I through the seal of cap T of the first vial 32, forming a closed system. (It will be understood that if registration pin 138 is not aligned with and thus is prevented from entering registration holes 67, 92, e.g. if holes 67, 92 are misaligned or pin 138 or fixture 130 is out of position, then fill nozzle 132 cannot reach tube I or cap T of vial 32, and an error condition is noted and the process is halted.) Actuator 106 fills liquid dispenser 100 with a desired amount of fluid from the reservoir and fill line 110 (as by withdrawing a syringe plunger from its barrel), if such filling has not already occurred, and when fill nozzle 132 is in tube I actuator 106 forces liquid from dispenser 100 through fill line 114 and into inlet tube I (as by forcing syringe plunger into its barrel). As liquid is forced into inlet tube I, the pressure on it forces the liquid also into chamber C of vial 32, with air in chamber C forced out through vent tube V. When fill nozzle 132 is lifted from seal cap T, the valve inside of cap T closes, so that no more liquid enters chamber C, and any liquid remaining in inlet tube I stays there. At this point, an amount of liquid is in chamber C with air in a head space over it, and an aliquot of liquid also remains in inlet tube I above the head space in chamber C.

Fixture 130 is then lifted to its upper position, and carriage 21 is moved forward the distance between individual slots 54, 62, 80 or between individual registration holes 67, 92. Fixture 130 is then lowered so that registration pin 138 enters the second registration hole 67, 92. At that time liquid fill nozzle 132 enters the inlet tube I through cap T of a second vial 32, and air nozzle 134 enters the inlet tube I through sealed cap T of the first vial 32. Filling the second vial 32 with liquid proceeds as described above. With air nozzle 134 in tube I of the first vial 32, actuator 106 causes air dispenser 102 to force air through air line 126 (e.g. by forcing plunger into barrel of syringe 102 in the illustrated embodiment) and into inlet tube I. The forced air enters inlet tube I to create an upper air pocket or head space above the aliquot of fluid in tube I, and also forces some of the liquid in the aliquot into chamber C of the first vial 32. Actuator 106 then causes air dispenser 102 to remove an amount of air from the upper air pocket over the aliquot in inlet tube I, e.g. by withdrawing the plunger of syringe 102 somewhat, which results in upward movement of the aliquot within tube I, and the creation of a lower air pocket in inlet tube I under the aliquot, from the air in the head space over the liquid in chamber C. Fixture 130 moves upward after the filling and air treatment is completed, resulting in a closed vial 32 with an amount of liquid in chamber C and an air-filled head space above it, and an aliquot of the liquid in inlet tube I that is bounded by separate air pockets above and below it.

The filling of each vial 32 continues as described above until the last vial 32 in a tray 170 is complete. Any vial 32 in which an aliquot of liquid is desired for testing or other purposes will be treated with the air treatment as indicated above. It will be understood that not every vial 32 in a tray 170 must include such an aliquot. In particular embodiments, of groups of ten vials in a tray, only one, two or three may include such an aliquot in their respective inlet tubes. For vials 32 in which no aliquot is needed or desired, the air treatment when air nozzle 134 is inserted through the seal in cap T of vial 32 is a sufficient amount of air forced through air line 126 to move all of the liquid from tube I into chamber C, leaving only air in inlet tube I.

Following filling of the last vial 32 in the tray 170, i.e. as fixture 130 arrives at the end of tray 170, vial sensor 145 attached to wall 144 in loading zone 22 senses the lack of another vial. Software controls use that information to prevent actuating liquid dispenser 100, so that no liquid is dispensed. At that position, there will still be a need to air-treat the last vial 32, as described above. Following air treatment of the last vial 32, after fixture 130 rises and with the sensor 145 noting the lack of further vials, carriage 21 is moved on to the sealing zone 24.

When carriage 21 arrives between the sealing bars 150 in sealing zone 24, the vials 32 are positioned so that at least inlet tube I (and in the illustrated embodiment at least part of vent tube V) is positioned between bars 150 for sealing. As noted above, bars 150 are forced together pneumatically, contacting inlet tubes I of the respective vials 32 at the air pockets on either side of an aliquot of liquid within such tubes I as include them. The inside pinching elements 156 tend to force air in each pocket toward the aliquot, keeping the liquid from heated sealing elements 154. The heated sealing elements 154 press against tubes I outside of the pinching elements 156 to seal tubes I. For vials 32 having not aliquot of liquid in their respective tubes I, if any, sealing occurs at the same relative location on tubes I. Sealing of vials 32 occurs in one step of pneumatically or otherwise pressing bars 150, since in the illustrated embodiment the length of bars 150 is sufficient to reach all such vials in a carriage 21.

After sealing is complete, carriage 21 is moved from sealing zone 24 to unloading zone 26. After it stops in unloading zone 26, the operator can remove tray 170 of filled vials 32 from carriage 21, by pivoting locking bar 58 around post 56 to an open position, and then pulling inlet tubes I and/or caps T of respective vials 32 from their respective slots in guide 60 and platform 50. Trays 170 of filled vials 32 may be stacked in a holding rack (not shown), so that the product of several runs of carriage 21 may be collected before moving it to another processing station (e.g. a freezing or sterilizing station).

After the operator removes the tray of filled vials from carriage 21, a new tray 170 of empty and unsealed vials 32 are loaded into carriage 21, as described above. In some embodiments, carriage 21 is returned to loading zone 22 (as by pressing a foot switch as noted above) and then the insertion of a new tray of empty vials is made. It will be understood that the loading of a new tray of empty vials may occur in other embodiments when the unloaded carriage 21 is in the unloading zone 26, so that the next operation is returning such a tray through sealing zone 24 (without the sealing steps) and to loading zone 22. Filling may then automatically commence in some examples, while in others a further activation (e.g. another pressing of the switch) is required to begin the filling sequence.

Controls 28 are implemented through software connected to the actuators and other moving parts discussed above. While zones 22, 24 and 26 form a unit that may be placed in a sterile environment, controls 28 (other than controllers located with moving parts in that unit) are generally remote from the unit. In particular embodiments, each moving part includes a hardware controller 200 linked via software to a system controller 202. An operator or remote manager observes the operation via software on a remote computer 204, e.g. a PC or laptop computer linked to system controller 202. With an internet or other network connection, the user of such remote computer need not be in the same area, or indeed in the same country as the operator of the unit including zones 22, 24 and 26. A separate computer 206, e.g. a data server, may also be connected electronically to computer 204 and/or controller 202, to collect data, monitor overall performance of the system, or perform other tasks as may be desired.

In a particular embodiment, the local controls for system 20 (i.e. controls other than computers 204 and 206) are contained in a single case 210 of approximately the size and configuration of a desktop computer tower. Case 210 includes necessary communications connections (e.g. Ethernet connections and/or switches), power connections, digital controller 202, controls for pressurized air (e.g. a solenoid), vacuum connections, and/or other desirable hardware. As noted above, in some embodiments exhaust from pneumatic controllers 152 is vented outside of unit 29, and in a particular embodiment is vented via connections to and through case 210. The switch for beginning processes described above, e.g. a foot switch, may be connected to controller 202 or other hardware of case 210. One or more termination or "emergency stop" buttons are preferably included with controls 28, and may be located with unit 29 (either fixed to or alongside it) and/or with case 210.

While the subject matter herein has been illustrated and described in detail in the exemplary drawings and foregoing description, the same is to be considered as illustrative and not restrictive in character, it being understood that only the preferred embodiment(s) have been shown and described and that all changes and modifications that come within the spirit of the disclosure are desired to be protected. It will be understood that structures, methods or other features described particularly with one embodiment can be similarly used or incorporated in or with respect to other embodiments.

What is claimed is:

1. An apparatus for filling vials having a chamber and an inlet tube with therapeutic biological liquids, comprising:

a carriage for holding a plurality of the vials through a filling and sealing process, wherein the carriage includes a tray as a base, the tray having side upwardly-extending walls;

a liquid nozzle connected to a liquid dispenser that draws from a liquid reservoir, the liquid nozzle lowerable into inlet tubes of individual vials to dispense liquid via the inlet tube into the vial chamber so that some liquid remains in the inlet tube;

an air nozzle connected to an air dispenser and dispensing filtered air, the air nozzle lowerable into inlet tubes of individual vials and operable to force air into the inlet tube to force liquid through the inlet tube into the vial chamber and to create suction to remove a portion of air from the inlet tube so as to leave an aliquot of liquid between air pockets in the inlet tube;

at least one pair of sealing bars, each having a pair of heating elements separated by at least the distance between the air pockets, adapted to be pressed together against the inlet tube to make seals in the inlet tube on either side of the aliquot in the inlet tube.

2. An apparatus for filling vials having a chamber and an inlet tube with therapeutic biological liquids, comprising:

a carriage for holding a plurality of the vials through a filling and sealing process, wherein the carriage includes a tray as a base, the tray having side upwardly-extending walls;

a liquid nozzle connected to a liquid dispenser that draws from a liquid reservoir, the liquid nozzle lowerable into inlet tubes of individual vials to dispense liquid via the inlet tube into the vial chamber so that some liquid remains in the inlet tube;

an air nozzle connected to an air dispenser and dispensing filtered air, the air nozzle lowerable into inlet tubes of individual vials and operable to force air into the inlet tube to force liquid through the inlet tube into the vial chamber and to create suction to remove a portion of air from the inlet tube so as to leave an aliquot of liquid between air pockets in the inlet tube;

at least one pair of sealing bars, each having a pair of heating elements separated by at least the distance between the air pockets, adapted to be pressed together against the inlet tube to make seals in the inlet tube on either side of the aliquot in the inlet tube, wherein the carriage includes supports extending upward from the tray, and an upper mount attached to the supports, the upper mount having a horizontal arm with a set of slots for accommodating vials, and further comprising a locking bar pivotally connected to the upper mount at a pivot point and having a series of slots, the locking bar being pivotable outward from a closed position in which the locking bar slots are generally aligned with the slots of the horizontal arm of the upper mount, and wherein a plurality of the locking bar slots have an edge closer to the pivot point that has a convex curve.

3. The apparatus of claim 2, wherein the carriage includes supports extending upward from the tray, and an upper mount attached to the supports, the upper mount having a horizontal arm with a set of slots for accommodating vials.

4. The apparatus of claim 3, further comprising a guide attached to the upper mount, the guide having a series of slots aligned with at least part of the slots of the horizontal arm of the upper mount, and that are sized to permit a portion of an individual vial to snap into an individual guide slot.

5. The apparatus of claim 3, wherein the supports have a quick-release connection to allow at least part of the carriage to be removed from the apparatus and replaced.

6. The apparatus of claim 2, wherein a first of the plurality of the locking bar slots has a convex curve with a first curvature, and a second of the plurality of the locking bar slots that is farther from the pivot point has a second curvature that is less than the first curvature.

7. The apparatus of claim 2, wherein a plurality of the sealing bars have a U-shape, with a central depression separating a plurality of unheated pinching elements, and further including a respective heating element fixed outside of each pinching element.

8. The apparatus of claim 2, wherein the apparatus is a unit having a filling zone separated from a sealing zone by a wall, wherein the liquid nozzle and the air nozzle are within the filling zone, and the sealing bars are within the sealing zone.

9. The apparatus of claim 8, wherein the apparatus has an unloading zone separated from the sealing zone opposite the filling zone, and wherein the carriage has an underside with a drive linkage, and further comprising a threaded drive rod extending through the filling, sealing and unloading zones and being operationally connected to the drive linkage, so that when the threaded drive rod turns in a first direction the carriage moves toward an end of the unloading zone opposite the sealing zone, and when the threaded drive rod turns in a second direction the carriage moves toward an end of the filling zone opposite the sealing zone.

10. The apparatus of claim 8, wherein the sealing zone has an open top and an opening through the wall, and wherein one or more sensors are placed around the open top and opening to detect undesired objects.

11. The apparatus of claim 2, wherein the apparatus is a unit configured for use under a biological hood.

12. The apparatus of claim 11, further comprising control hardware and software located at least partially remotely from the biological hood.

13. The apparatus of claim 2, wherein at least a portion of the liquid dispenser and at least a portion of the air dispenser is fixed to a rear wall of the apparatus.

14. An apparatus for filling vials having a chamber and an inlet tube with therapeutic biological liquids, comprising:

a carriage for holding a plurality of the vials through a filling and sealing process, wherein the carriage includes a tray as a base, the tray having side upwardly-extending walls;

a liquid nozzle connected to a liquid dispenser that draws from a liquid reservoir, the liquid nozzle lowerable into inlet tubes of individual vials to dispense liquid via the inlet tube into the vial chamber so that some liquid remains in the inlet tube;

an air nozzle connected to an air dispenser and dispensing filtered air, the air nozzle lowerable into inlet tubes of individual vials and operable to force air into the inlet tube to force liquid through the inlet tube into the vial chamber and to create suction to remove a portion of air from the inlet tube so as to leave an aliquot of liquid between air pockets in the inlet tube;

at least one pair of sealing bars, each having a pair of heating elements separated by at least the distance between the air pockets, adapted to be pressed together against the inlet tube to make seals in the inlet tube on either side of the aliquot in the inlet tube, wherein the liquid nozzle and air nozzle are part of a fill fixture, and wherein the fill fixture further includes a registration pin and is fixed to a platform that moves vertically between an upper position clear of the vials and a lower position.

15. The apparatus of claim 14, wherein the carriage includes supports extending upward from the tray, and an upper mount attached to the supports, the upper mount having a horizontal arm with a set of slots for accommodating vials.

16. The apparatus of claim 15, further comprising a guide attached to the upper mount, the guide having a series of slots aligned with at least part of the slots of the horizontal arm of the upper mount, and that are sized to permit a portion of an individual vial to snap into an individual guide slot.

17. The apparatus of claim 15, wherein the supports have a quick-release connection to allow at least part of the carriage to be removed from the apparatus and replaced.

18. The apparatus of claim 14, wherein a plurality of the sealing bars have a U-shape, with a central depression separating a plurality of unheated pinching elements, and further including a respective heating element fixed outside of each pinching element.

19. The apparatus of claim 14, wherein the apparatus is a unit having a filling zone separated from a sealing zone by a wall, wherein the liquid nozzle and the air nozzle are within the filling zone, and the sealing bars are within the sealing zone.

20. The apparatus of claim 19, wherein the apparatus has an unloading zone separated from the sealing zone opposite the filling zone, and wherein the carriage has an underside with a drive linkage, and further comprising a threaded drive rod extending through the filling, sealing and unloading zones and being operationally connected to the drive linkage, so that when the threaded drive rod turns in a first direction the carriage moves toward an end of the unloading zone opposite the sealing zone, and when the threaded drive rod turns in a second direction the carriage moves toward an end of the filling zone opposite the sealing zone.

21. The apparatus of claim 19, wherein the sealing zone has an open top and an opening through the wall, and wherein one or more sensors are placed around the open top and opening to detect undesired objects.

22. The apparatus of claim 14, wherein the apparatus is a unit configured for use under a biological hood.

23. The apparatus of claim 22, further comprising control hardware and software located at least partially remotely from the biological hood.

24. The apparatus of claim 14, wherein at least a portion of the liquid dispenser and at least a portion of the air dispenser is fixed to a rear wall of the apparatus.

* * * * *